US008562183B2

(12) United States Patent
Quadri

(10) Patent No.: US 8,562,183 B2
(45) Date of Patent: Oct. 22, 2013

(54) ACTUATING ASSEMBLY FOR STAGE LIGHT FITTING BEAM PROCESSING MEMBERS, AND STAGE LIGHT FITTING COMPRISING SUCH AN ASSEMBLY

(75) Inventor: Pasquale Quadri, Torre de' Roveri (IT)

(73) Assignee: Clay Paky S.p.A., Seriate (IT)

( * ) Notice: Subject to any disclaimer, the term of this patent is extended or adjusted under 35 U.S.C. 154(b) by 471 days.

(21) Appl. No.: 12/808,845

(22) PCT Filed: Dec. 17, 2008

(86) PCT No.: PCT/IB2008/003516

§ 371 (c)(1),
(2), (4) Date: Aug. 23, 2010

(87) PCT Pub. No.: WO2009/081256

PCT Pub. Date: Jul. 2, 2009

(65) Prior Publication Data

US 2010/0309667 A1 Dec. 9, 2010

(30) Foreign Application Priority Data

Dec. 18, 2007 (IT) ..... MI2007A2368

(51) Int. Cl.
*F21V 17/02* (2006.01)

(52) U.S. Cl.
USPC ..... 362/324; 362/319; 362/321

(58) Field of Classification Search
USPC ..... 362/319, 321, 324
See application file for complete search history.

(56) References Cited

U.S. PATENT DOCUMENTS

| | | | | |
|---|---|---|---|---|
| 3,538,825 | A * | 11/1970 | Taylor | 362/4 |
| 4,037,097 | A * | 7/1977 | Stillman et al. | 362/324 |
| 4,350,417 | A * | 9/1982 | Freeman | 353/90 |
| 4,800,474 | A * | 1/1989 | Bornhorst | 362/293 |
| 4,893,225 | A * | 1/1990 | Solomon | 362/293 |
| 6,241,366 | B1 * | 6/2001 | Roman et al. | 362/293 |
| 6,687,063 | B1 * | 2/2004 | Rasmussen et al. | 359/887 |
| 6,796,682 | B2 * | 9/2004 | Hough et al. | 362/268 |
| 7,527,389 | B2 * | 5/2009 | Belliveau et al. | 362/231 |
| 7,896,525 | B2 * | 3/2011 | Belliveau et al. | 362/282 |
| 7,993,027 | B2 * | 8/2011 | Belliveau et al. | 362/268 |
| 8,042,974 | B2 * | 10/2011 | Sherman et al. | 362/321 |
| 8,113,691 | B2 * | 2/2012 | Jurik | 362/293 |
| 2005/0047148 | A1 * | 3/2005 | Gennrich et al. | 362/321 |
| 2005/0052872 | A1 * | 3/2005 | de Peralta | 362/321 |
| 2007/0211468 | A1 * | 9/2007 | Allegri | 362/268 |
| 2010/0061107 | A1 * | 3/2010 | Jurik | 362/319 |

FOREIGN PATENT DOCUMENTS

| | | |
|---|---|---|
| EP | 1832807 | 9/2007 |
| GB | 2317003 | 3/1998 |
| WO | WO 2007/098720 | 9/2007 |

* cited by examiner

*Primary Examiner* — Anne Hines
*Assistant Examiner* — Jose M Diaz
(74) *Attorney, Agent, or Firm* — Leason Ellis, LLP

(57) ABSTRACT

An actuating assembly for beam processing members of a stage light fitting for generating a light beam has a frame; at least a first and second beam processing member; a motor with a shaft; and transmission means for transmitting motion to the first and second beam processing member, and which connect the shaft of the motor to the first and second beam processing member to selectively move the first and second beam processing member successively between a first position of non-interference with the beam, and a second position of interference with the beam.

20 Claims, 5 Drawing Sheets

ACTUATING ASSEMBLY FOR STAGE LIGHT FITTING BEAM PROCESSING MEMBERS, AND STAGE LIGHT FITTING COMPRISING SUCH AN ASSEMBLY

TECHNICAL FIELD

The present invention relates to an actuating assembly for stage light fitting beam processing members, and to a stage light fitting comprising such an assembly.

BACKGROUND ART

A known stage light fitting comprises a casing extending along a longitudinal axis; and a light source housed inside the casing to generate a light beam. The light fitting normally comprises a beam processing member actuating assembly for moving one or more beam processing members between a first position of non-interference with the beam, and a second position interfering with, and normally to spread, the beam emitted by the light fitting.

A known beam processing member actuating assembly comprises a frame with a central hole; four half-disk-shaped beam processing members arranged in a first and second pair diametrically opposite with respect to the axis of the light fitting; four motors; and transmission means for transmitting motion from each motor to the respective beam processing member.

Actuating assemblies of the above type, however, are excessively bulky.

The ever-increasing need for smaller light fittings is reflected in a reduction in the space inside the light fitting casing.

Moreover, beam processing means (gobos, coloured lenses, etc.) for producing special lighting effects often have to be inserted between the light source and the beam processing member actuating assembly, and, being far from negligible in size, further reduce the space available inside the casing for the actuating assembly.

DISCLOSURE OF INVENTION

It is an object of the present invention to provide a beam processing member actuating assembly designed to eliminate the aforementioned drawbacks of the known art, and which in particular is both compact and cheap and easy to produce.

According to the present invention, there is provided an actuating assembly for beam processing members of a stage light fitting for generating a light beam; the actuating assembly comprising a frame, at least a first and second beam processing member, drive means, and transmission means for transmitting motion to the first and second beam processing member to selectively move the first and second beam processing member between a first position of non-interference with the beam, and a second position of interference with the beam; the actuating assembly being characterized in that the drive means comprise a motor having a shaft; and in that the transmission means connect the shaft of the motor to the first and second beam processing member to selectively move the first and second beam processing member successively.

It is also an object of the present invention to provide a compact, efficient stage light fitting.

According to the present invention, there is provided a stage light fitting comprising a casing extending along a longitudinal axis, and a light source housed inside the casing to generate a light beam; the light fitting being characterized by comprising a beam processing member actuating assembly as claimed in any one of claims 1 to 18.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
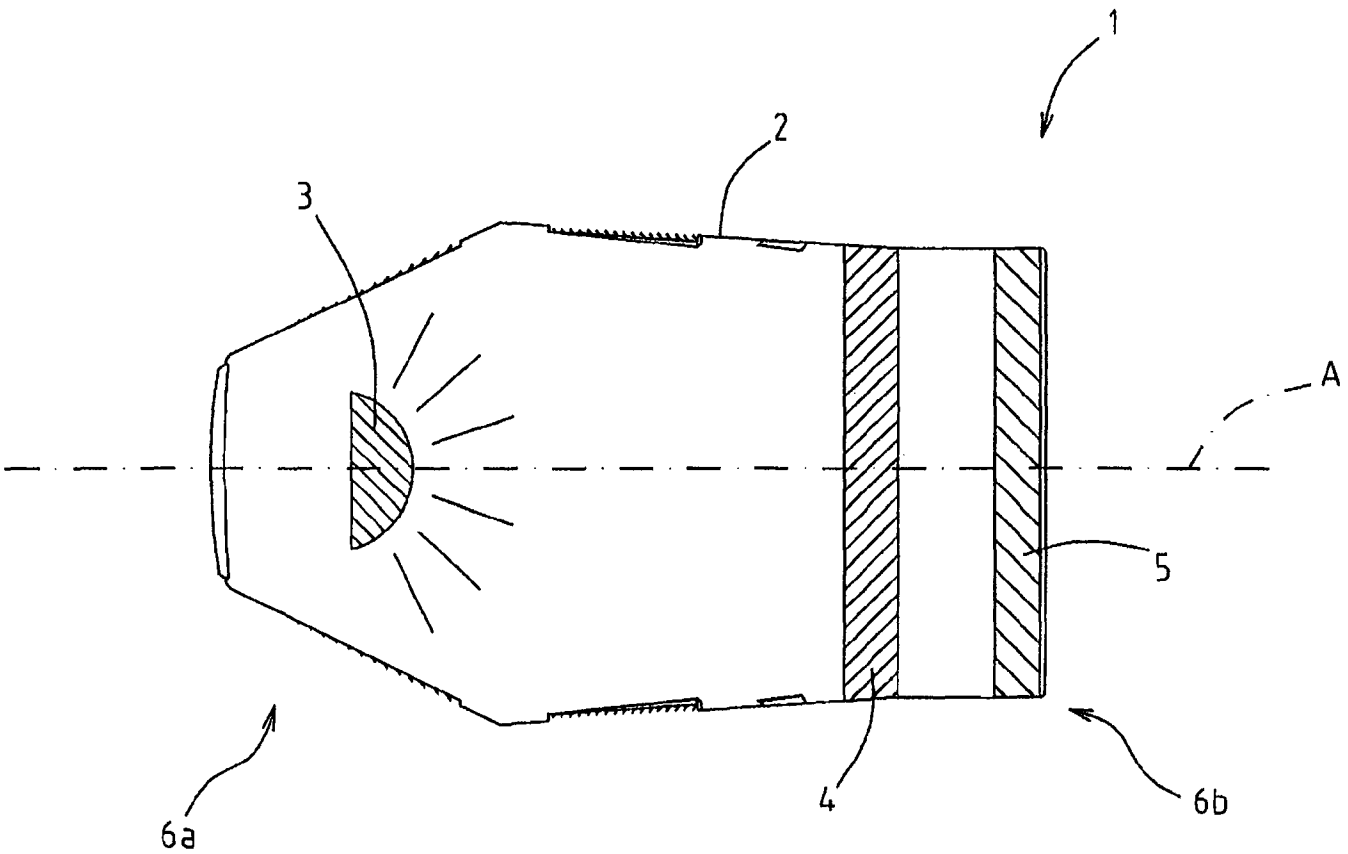
FIG. 1 shows a schematic section of a light fitting in accordance with the present invention.

Number 1 in FIG. 1 indicates a stage light fitting comprising a casing 2; a light source 3; a beam processing member actuating assembly 4; and a lens 5.

Casing 2 extends substantially along a longitudinal axis A, and has a rear end 6*a* and a front end 6*b*.

Light source 3 is housed inside casing 2, close to rear end 6*a*, and emits a light beam substantially parallel to axis A of casing 2.

Lens 5 is the final lens of light fitting 1, and is housed inside casing 2, at front end 6*b*. More specifically, lens 5 is circular and concentric with axis A, and, depending on requirements, may be planoconvex, a zoom, a Fresnel lens, etc.

Actuating assembly 4 is housed inside casing 2, between light source 3 and lens 5. More specifically, actuating assembly 4 is substantially perpendicular to axis A, and is located close to front end 6*b* of casing 2, so beam processing means (not shown), such as gobos, coloured lenses, etc., for producing special lighting effects can be inserted between actuating assembly 4 and light source 3.

Figure 3:
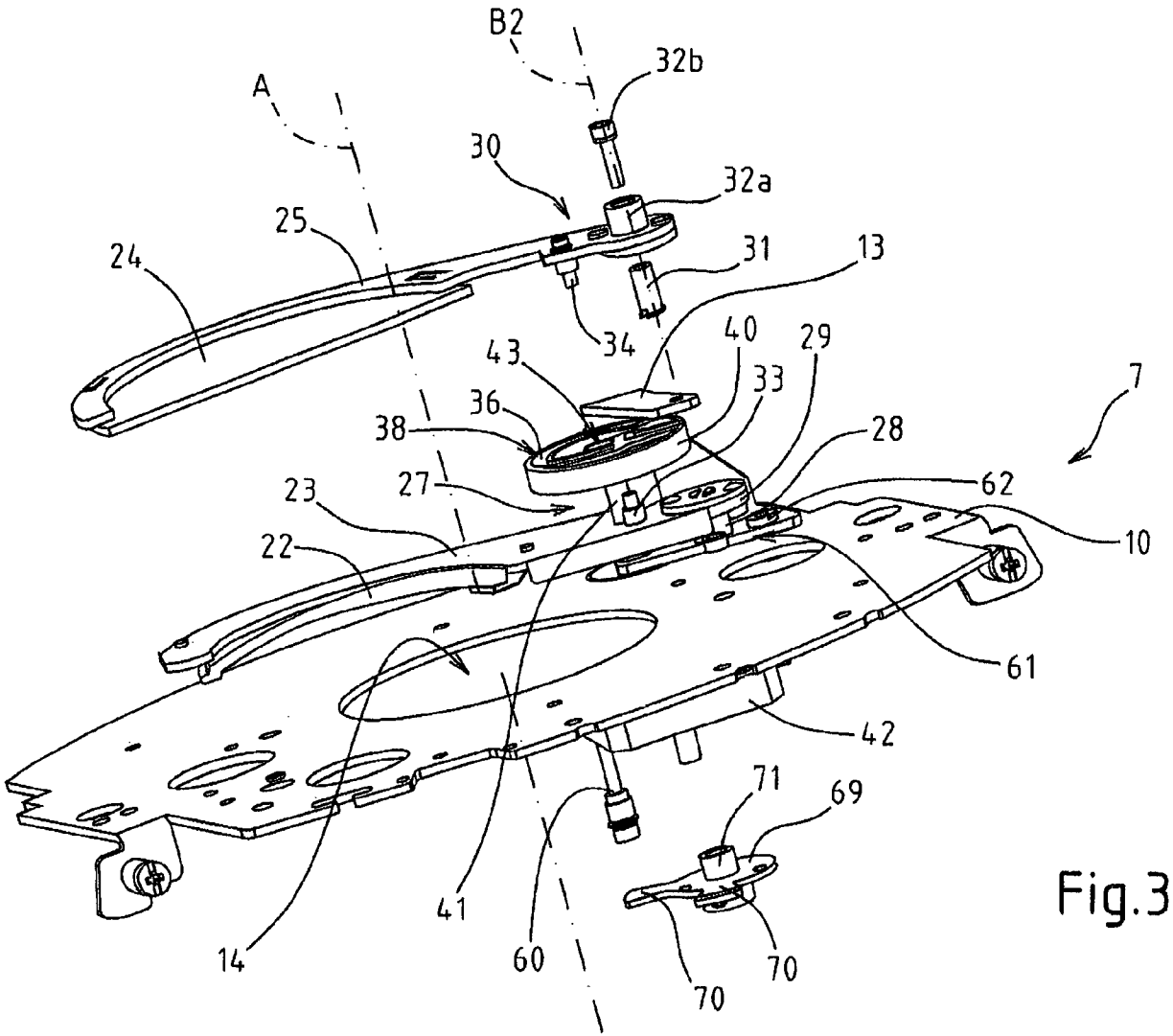
FIG. 3 shows an exploded view in perspective, from a first angle and with parts removed for clarity, of a detail of the beam processing member actuating assembly in FIG. 2.

With reference to FIG. 3, actuating assembly 4 comprises a frame 7; at least two beam processing members, or, as in the examples shown, a first pair 8 of beam processing members, and a second pair 9 of beam processing members diametrically opposite the first pair with respect to axis A; and at least one beam processing member actuating device, or, as in the examples shown, a first actuating device 11 for the first pair 8 of beam processing members, and a second actuating device 12 for the second pair 9 of beam processing members and located diametrically opposite the first actuating device with respect to axis A.

First and second actuating device 11, 12 respectively comprise drive means and transmission means, and respectively move the first and second pair 8, 9 of beam processing members between a first position of non-interference with the beam, and a second position of interference with the beam.

The first and second pair 8, 9 of beam processing members being substantially identical, and the first and second actuating device 11, 12 also being substantially identical, only one of pairs 8, 9 of beam processing members, and only one of actuating devices 11, 12 will be described below for the sake of simplicity, and no reference numbers are indicated in the drawings for the component parts of second pair 9 of beam processing members, and second beam processing member actuating device 12.

Frame 7 comprises a metal plate 10; and two substantially C-shaped brackets 13. Being substantially identical, only one of brackets 13 is described below.

Plate 10 is substantially perpendicular to axis A, and has a central hole 14, substantially coaxial with axis A, for passage of the beam generated by light source 3 of light fitting 1.

Plate 10 also has lateral holes 15 for assembly to casing 2 of light fitting 1.

Plate 10 is fitted with two gradual shutters 17 for cutting off the beam through central hole 14, and each of which is substantially sickle-shaped with one end connected to plate 10. More specifically, ends of gradual shutters 17 pivot respectively at two holes 18 located alongside central hole 14 and along the centreline M of plate 10 perpendicular to axis A. Each gradual shutter 17 is operated by respective controlled actuating means not shown in the drawings for the sake of simplicity.

Plate 10 comprises a portion 19 and a portion 20, which are substantially separate, are defined by the centreline M of plate 10 perpendicular to axis A, and are fitted respectively with two counterweights defined by two metal plates (not shown) of given weight, and for compensating the weight of light source 3 and the beam processing means housed inside casing 2, close to rear end 6*a*.

With reference to FIG. 3, pair 8 of beam processing members comprises a half-disk-shaped first beam processing member 22 fitted to a first supporting structure 23; and a half-disk-shaped second beam processing member 24 fitted to a second supporting structure 25.

First beam processing member 22 is preferably a lens for spreading the beam through it, and is defined by a number of assembled microlenses; and second beam processing member 24 is preferably a lens for spreading the beam through it, and is defined by a number of assembled microlenses larger than the microlenses defining first beam processing member 22.

Figure 2:
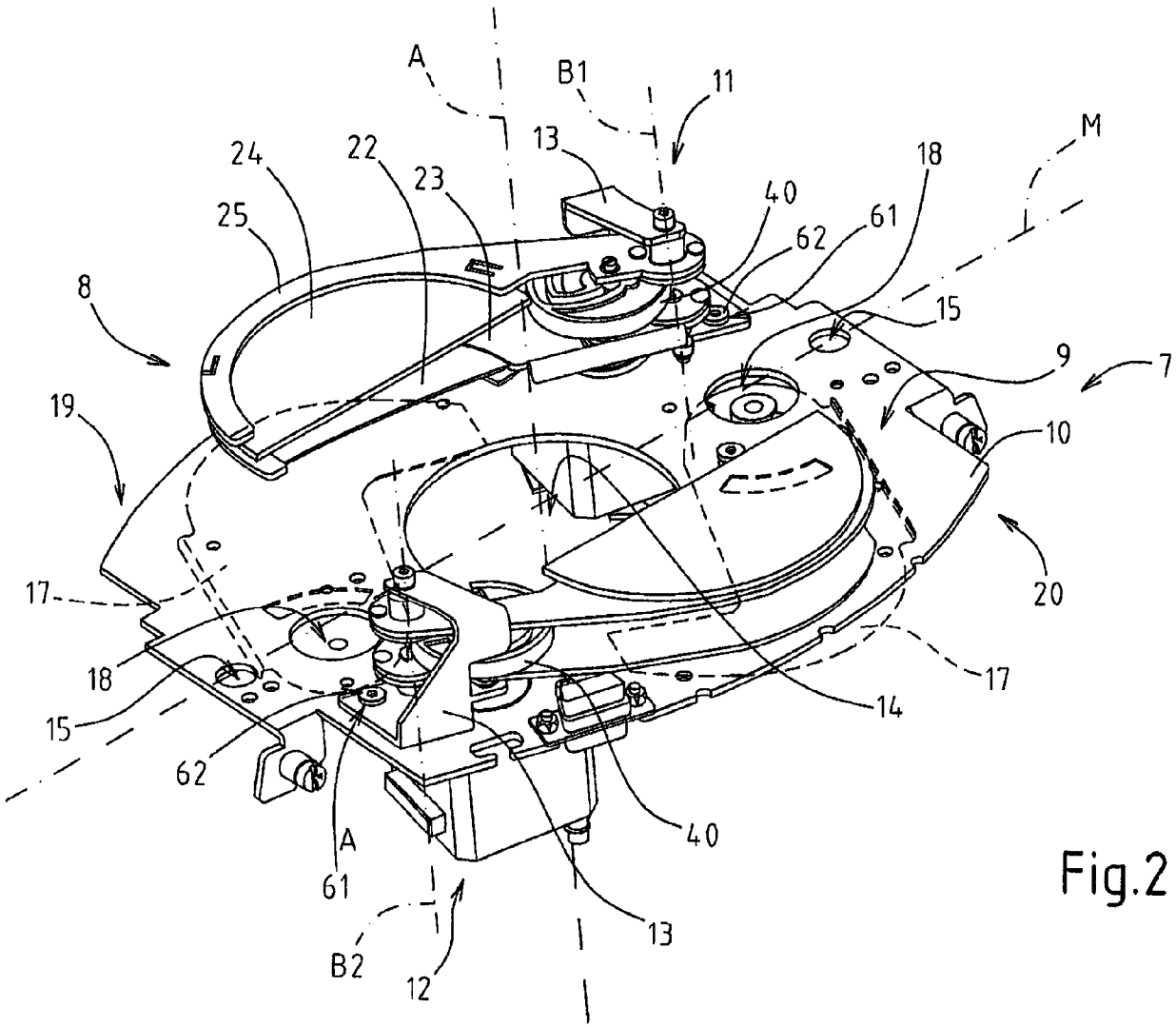
FIG. 2 shows a view in perspective of a light fitting beam processing member actuating assembly in accordance with the present invention.

The first pair 8 of beam processing members rotates substantially about an axis B1 substantially perpendicular to plate 10 and substantially parallel to axis A of casing 2. Axis B2 in FIG. 2 indicates the axis of rotation of the second pair 9 of beam processing members.

More specifically, first supporting structure 23 and second supporting structure 25 rotate about axis B1. One end 27 of first supporting structure 23, in fact, is connected for rotation to a pin 28 by connecting means, e.g. a bushing 28 and a pin fastening screw (not shown).

Similarly, one end 30 of second supporting structure 25 is connected for rotation to a pin 31 by connecting means, e.g. a bushing 32*a* and a pin fastening screw 32*b*.

Pin 28 and pin 31 are coaxial, extend substantially along axis B1, and, as described in detail below, are fixed to frame 7, so that first supporting structure 23 and second supporting structure 25 are parallel to each other.

At respective ends 27 and 30, first supporting structure 23 and second supporting structure 25 have respective pins 33 and 34, which engage respective tracks 35 (FIG. 5) and 36 (FIG. 6) on opposite faces 37 (FIG. 5) and 38 (FIG. 6) of a positive cam 40.

Positive cam 40 is substantially a preferably circular disk, and is connected to the drive means, in particular to a shaft 41 of a motor 42.

Cam 40 has a central hole 43 and is fixed to shaft 41 of motor 42.

Figure 5:
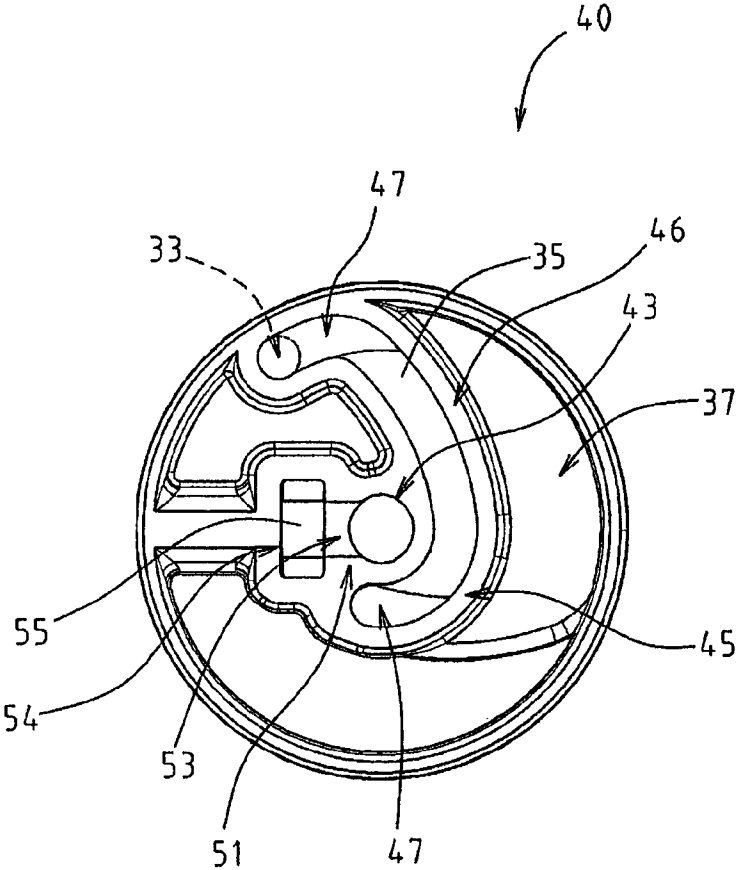
FIG. 5 shows a topside plan view, with parts removed for clarity, of a further detail of the beam processing member actuating assembly in FIG. 2.

With reference to FIG. 5, face 37 of cam 40 has track 35, which is engaged by pin 33 to guide first supporting structure 23 of first beam processing member 22. Track 35 extends along a path comprising a constant-radius first curved portion 45 and a variable-radius second curved portion 46 longer than first curved portion 45, and has two through portions 47 at the ends.

Figure 6:
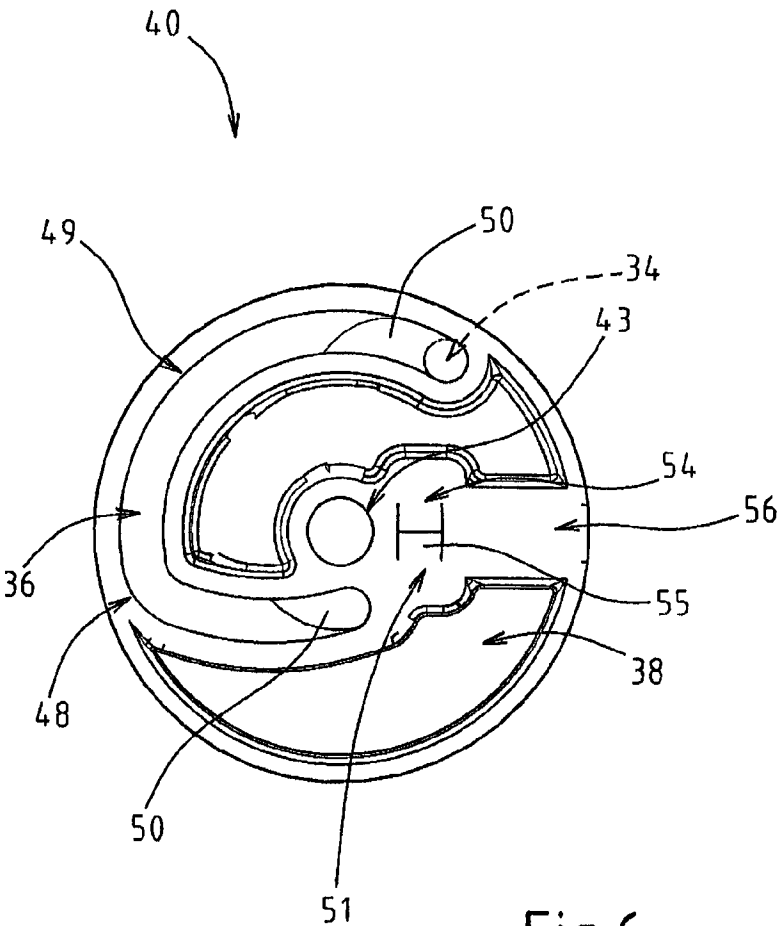
FIG. 6 shows an underside plan view, with parts removed for clarity, of the FIG. 5 detail of the beam processing member actuating assembly.

With reference to FIG. 6, face 38 of cam 40 has track 36, which is engaged by pin 34 to guide second supporting structure 25 of second beam processing member 24. Track 36 extends along a path comprising a variable-radius first curved portion 48 and a constant-radius second curved portion 49 longer than first curved portion 48, and has two through portions 50 at the ends.

With reference to FIGS. 5 and 6, cam 40 has a seat 51 comprising a non-through first portion 53 open on the face 37 side and connected to hole 43 housing shaft 41 (FIG. 5); a through second portion 54 housing a nut 55 (FIGS. 5 and 6); and an elongated third portion 56 open on the face 38 side (FIG. 6) and for housing a screw (not shown) which screws into nut 55 and rests against shaft 41 to fix cam 40 to shaft 41.

Figure 4:
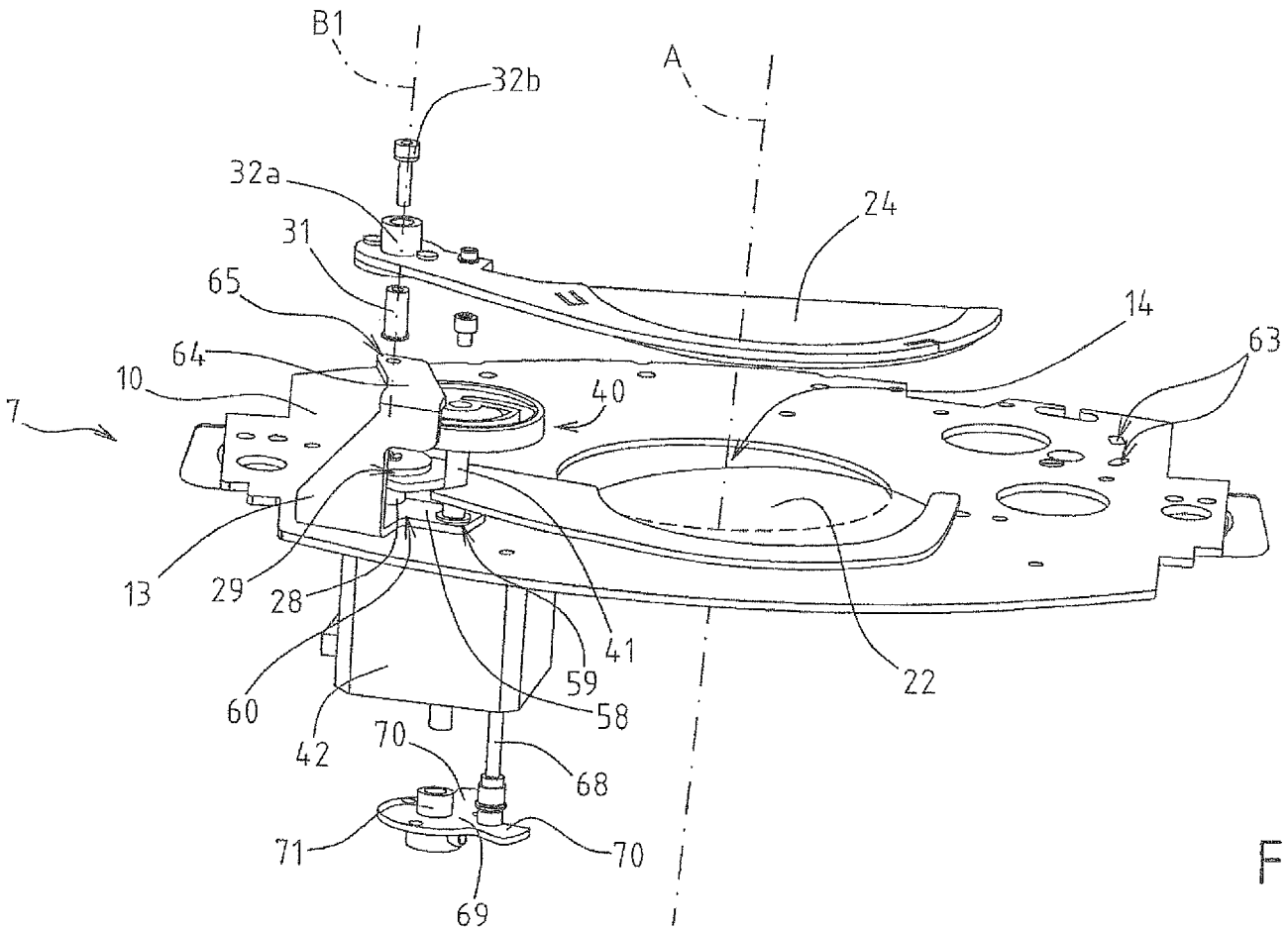
FIG. 4 shows an exploded view in perspective, from a second angle and with parts removed for clarity, of the FIG. 3 detail of the beam processing member actuating assembly.

With reference to FIG. 4, pin 28 and pin 31 are connected to frame 7, and in particular to a bracket 13 connected to shaft 41 of motor 42. More specifically, bracket 13 comprises a bottom base 58 having a circular hole 59 for shaft 41, a circular hole 60 for pin 28, and two circular holes 61 (shown in FIGS. 2 and 3) for screws 62 for assembly to plate 10. More specifically, each screw 62 is connected to a respective slot 63 in plate 10 (shown in FIG. 4, on the diametrically opposite side of axis A). Adjusting the position of screws 62 in slots 63 provides for adjusting the position of beam processing members 22, 24 with respect to central hole 14 of plate 10, so that beam processing members 22, 24 substantially cover exactly half central hole 14 in the second position of interference with the beam.

Bracket 13 also has a top base 64 with a hole 65 for pin 31.

Motor 42 is preferably a step motor which rotates shaft 41 anticlockwise to move beam processing members 22, 24 from the first position of non-interference to the second position of interference with the beam, and clockwise to move beam processing members 22, 24 from the second position of interference to the first position of non-interference with the beam.

More specifically, given the design of tracks 35 and 36 of positive cam 40, anticlockwise rotation of shaft 41 first moves first beam processing member 22 and then second beam processing member 24; while clockwise rotation first moves second beam processing member 24 and then first beam processing member 22.

Motor 42 preferably performs a predetermined number of clockwise steps and a predetermined number of anticlockwise steps to avoid positioning beam processing members 22 and 24 between the first and second position. Motor 42 may, however, be programmed to also position beam processing members 22, 24 in one or more intermediate positions between the first and second position.

Motor 42 also has step reset means. More specifically, the step reset means comprise a stop pin 68; and a disk 69 having two wings 70 and fixed by a bushing 71 to shaft 41 of motor 42.

When a wing 70 of disk 69 contacts stop pin 68, motor 42 is in the reset position. In actual use, disk 69 moves integrally with shaft 41, and produced slip of motor 42 if motor 42 commences the predetermined number of steps from other than the reset position.

In a first variation not shown, the step motor reset means comprise an electronic device.

A second variation not shown employs a direct-current motor.

A third variation not shown of the present invention employs two positive cams connected to the same motor shaft, and each having a track for transmitting movement to a respective beam processing member.

Beam processing member actuating assembly 4 according to the present invention has the advantage of being much more compact than known beam processing member actuating assemblies. Using one motor 42 for driving a pair 8 of beam processing members, in fact, greatly reduces the size of the assembly; and using only one cam 40 for transmitting motion to the pair 8 of beam processing members further reduces the size of actuating assembly 4.

Above all, actuating assembly 4 according to the present invention is much cheaper to produce, by employing one motor 42, as opposed to two, to drive a pair 8 of beam processing members.

Clearly, changes may be made to the light fitting and beam processing member actuating assembly as described herein without, however, departing from the scope as defined in the accompanying Claims.

The beam processing members may be lenses, as described, or filters, in particular coloured filters. In a further embodiment, the beam processing members may be a jagged-edged dimming device and a diffusion disk, arranged so that the diffusion disk intercepts the beam before the dimming device to form a dimmer. The dimming devices are superimposed in the final beam intercepting position.

The invention claimed is:

1. An actuating assembly for beam processing members of a stage light fitting for generating a light beam; the actuating assembly (4) comprising a frame (7), at least a first and second beam processing member (22, 24), drive means, and transmission means for transmitting motion to the first and second beam processing member (22, 24) to selectively move the first and second beam processing member (22, 24) between a first position of non-interference with the beam, and a second position of interference with the beam; the actuating assembly (4) being characterized in that-the drive means comprise a motor (42) having a shaft (41); and in that the transmission means connect the shaft (41) of the motor (42) to the first and second beam processing member (22, 24) to selectively move the first and second beam processing member (22, 24) successively, wherein the transmission means comprises: a first supporting structure (23) supporting the first beam processing member (22), which rotates about an axis of rotation (B1); a second supporting structure (25) supporting the second beam processing member (24), which rotates about the axis of rotation (B1); and at least one cam (40) fixed to the shaft (41) of the motor (42).

2. An assembly as claimed in claim 1, characterized in that the transmission means comprise a first supporting structure (23) supporting the first beam processing member (22), which rotates about an axis of rotation (B1).

3. An assembly as claimed in claim 2, characterized in that the transmission means comprise a second supporting structure (25) supporting the second beam processing member (24), which rotates about the axis of rotation (B1).

4. An assembly as claimed in claim 3, characterized in that the transmission means comprise at least one cam (40) fixed to the shaft (41) of the motor (42).

5. An assembly as claimed in claim 4, characterized in that the cam (40) is a positive cam having a first face (37), and a first track (35) along the first face (37); the first track (35) being engaged by a first pin (33) of the first supporting structure (23) to guide the first beam processing member (22).

6. An assembly as claimed in claim 5, characterized in that the cam (40) has a second face (38) opposite the first face (37), and a second track (36) along the second face (38); the second track (36) being engaged by a second pin (34) of the second supporting structure (25) to guide the second beam processing member (24).

7. An assembly as claimed in claim 5, characterized in that the first track (35) extends along a path comprising a constant-radius first curved portion (45), and a variable-radius second curved portion (46) longer than the first curved portion (45).

8. An assembly as claimed in claim 6, characterized in that the second track (36) extends along a path comprising a variable-radius third curved portion (48), and a constant-radius fourth curved portion (49) longer than the third curved portion (48).

9. An assembly as claimed in claim 4, characterized in that the cam (40) comprises fastening means for fastening the cam (40) to the shaft (41).

10. An assembly as claimed in claim 9, characterized in that the fastening means of the cam (40) comprise a seat (51); a nut (55); and a screw, which screws into the nut (55) and is housed in the seat (51), resting against the shaft (41).

11. An assembly as claimed in claim 1, characterized in that the motor (42) moves the shaft (41) in one direction to selectively move the first beam processing member (22) and the second beam processing member (24) from the first position of non-interference with the beam to the second position of interference with the beam, and in the opposite direction to selectively move the first beam processing member (22) and the second beam processing member (24) from the second position of interference with the beam to the first position of non-interference with the beam.

12. An assembly as claimed in claim 11, characterized in that the motor (42) is a step motor.

13. An assembly as claimed in claim 12, characterized in that the motor (42) performs a predetermined number of steps in one direction, and a predetermined number of steps in the opposite direction.

14. An assembly as claimed in claim 13, characterized in that the motor (42) comprises step reset means.

15. An assembly as claimed in claim 14, characterized in that the step reset means comprise a stop pin (68); and a disk (69) having two wings (70) and fixed to the shaft (41) of the motor (42); the motor (42) being in a reset position when a wing (70) of the disk (69) rests against the stop pin (68).

16. An assembly as claimed in claim 1, characterized by comprising at least a third and a fourth beam processing member; a further motor; and further transmission means connecting the further motor to the third and fourth beam processing member to selectively move the third and fourth beam processing member successively between a first position of non-interference with the beam, and a second position of interference with the beam.

17. An assembly as claimed in claim 16, characterized in that the first beam processing member (22) and third beam processing member are half-disk-shaped and complementary with each other.

18. An assembly as claimed in claim 16, characterized in that the second beam processing member (24) and fourth beam processing member are half-disk-shaped and complementary with each other.

19. A stage light fitting comprising a casing (2) extending along a longitudinal axis (A), and a light source (3) housed inside the casing (2) and for generating a light beam; the light fitting (1) being characterized by comprising a beam processing member actuating assembly (4) as claimed in claim 1.

20. A stage light fitting as claimed in claim 19, characterized in that the actuating assembly (4) is located in front of the light source (3) and substantially perpendicular to the axis (A) of the casing (2) of the stage light fitting (1).

* * * * *